US005904827A

United States Patent [19]

Reynolds

[11] Patent Number: 5,904,827

[45] Date of Patent: May 18, 1999

[54] PLATING CELL WITH ROTARY WIPER AND MEGASONIC TRANSDUCER

[75] Inventor: H. Vincent Reynolds, Marcellus, N.Y.

[73] Assignee: Reynolds Tech Fabricators, Inc., E. Syracuse, N.Y.

[21] Appl. No.: 08/954,239

[22] Filed: Oct. 20, 1997

Related U.S. Application Data

[63] Continuation-in-part of application No. 08/731,508, Oct. 15, 1996, Pat. No. 5,683,564, and a continuation-in-part of application No. 08/873,154, Jun. 11, 1997, Pat. No. 5,865,894.

[51] Int. Cl.[6] ..... C25D 17/00; C25D 1/00

[52] U.S. Cl. ..... 205/68; 204/263; 205/148

[58] Field of Search ..... 204/263

[56] References Cited

U.S. PATENT DOCUMENTS

| | | | |
|---|---|---|---|
| 4,269,669 | 5/1981 | Soy et al. | 204/5 |
| 4,322,281 | 3/1982 | Wright et al. | 204/237 |
| 4,342,635 | 8/1982 | Becker et al. | 204/236 |
| 4,391,694 | 7/1983 | Runsten | 204/273 |
| 4,599,159 | 7/1986 | Hilbig | 204/266 |
| 4,686,014 | 8/1987 | Pellegrino et al. | 204/15 |
| 5,409,594 | 4/1995 | Al-Jibory et al. | 205/148 |
| 5,462,649 | 10/1995 | Keeney et al. | 205/93 |
| 5,472,592 | 12/1995 | Lowery | 205/137 |
| 5,514,258 | 5/1996 | Brinket et al. | 204/237 |
| 5,683,564 | 11/1997 | Reynolds | 205/68 |

*Primary Examiner*—Kathryn Gorgos
*Assistant Examiner*—Erica Smith-Hicks
*Attorney, Agent, or Firm*—Trapani & Molldrem

[57] ABSTRACT

A plating cell for plating a flat substrate employs a sparger to introduce a flow of electrolyte or other plating solution across the surface of the substrate to be plated. A fluid-powered rotary blade or wiper within the cathode chamber has a rotary blade with an edge spaced a small distance, preferably about three-eighths inch, from the substrate, and an annular turbine which rotates under a flow of the electrolytic fluid that is also being fed to the sparger. The rotary wiper is run at a speed between about 35 and 80 rpm and draws the electrolyte away from the substrate. This helps remove hydrogen bubbles that form during electroplating. In addition, a megasonic transducer applies megasonic acoustic energy to the solution, e.g., at 0.2 to 5 MHz.

5 Claims, 4 Drawing Sheets

PLATING CELL WITH ROTARY WIPER AND MEGASONIC TRANSDUCER

This invention is a continuation-in-part of my application Ser. No. 08/731,508, filed Oct. 15, 1996, now U.S. Pat. No. 5,683,564, and is also a continuation-in-part of my application Ser. No. 08/873,154, filed Jun. 11, 1997, now U.S. Pat. No. 5,865,894.

BACKGROUND OF THE INVENTION

This invention relates to wet process chemistry (galvanic or electroless) plating cells, and is more particularly directed to a technique that provides an even distribution of electrolyte or plating solution onto and across a substrate to be plated, and which prevents accumulation of bubbles or other plating by-products on the surface of the substrate. The invention is more particularly directed to an improved plating cell for either galvanic or electroless plating in which megasonic energy is applied to the solution in the plating cell. The invention is more specifically directed to a plating cell in which a fluid powered rotary wiper, in combination with the megasonic action of the transducer, ensures efficient and uniform plating, regardless whether the workpieces or substrates are rotated during the plating process.

Electroplating plays a significant role in the production of many rather sophisticated technology products, such as masters and stampers for use in producing digital compact discs or CDs. However, as these products have become more and more sophisticated, the tolerances of the plating process have become narrower and narrower. For example, in a modem CD, impurities or blemishes of one micron or larger can create unacceptable data losses. Current electroplating techniques can result in block error rates of 70, and with higher density recordings, the block error rate can be 90 or higher. Current plans to increase the data density of compact discs are being thwarted by the inability of plating techniques to control blemishes in the plating process.

A number of techniques for electro-depositing or coating on an article face have been described in the patent literature, but none of these achieves the high plating purity and evenness of application that are required for super-high density compact discs.

A recent technique that employs a laminar flow sparger or injection nozzle within the plating bath is described in my recent patent application Ser. No. 08/556,463, filed Nov. 13, 1995, now U.S. Pat. No. 5,597,460. The means described there achieve an even, laminar flow across the face of the substrate during the plating operation. A backwash technique carries the sludge and particulate impurities away from the article to be plated, and produces a flat plated article of high tolerance, such as a high-density compact disc master or stamper.

In the manufacture of compact discs, there is a step that involves the use of a so-called stamper. The stampers are negative discs that are pressed against the material for the final discs to create an impression that becomes the pattern of tracks in the product compact discs.

Stampers are nickel and are electroformed. The stampers are deposited on a substrate that has the data tracks formed on it, and has been provided with a conductive surface, e.g., by sputter coating. Then the substrate is placed into a plating tank. The nickel is introduced in solution into the process cell so that it can be electrochemically adhered onto the substrate surface, using standard electroplating principles. Present industry standards require the stamper to have an extremely high degree of flatness, and where higher density storage is to be achieved, the flatness tolerance for the nickel coating becomes narrower and narrower.

The flow regime for the plating solution within the tank or cell is crucial for successful operation. Flow regime is affected by such factors as tank design, fluid movement within the process vessel, distribution of fluid within the vessel and at the zone of introduction of the solution into the vessel, and the uniformity of flow of the fluid as it contacts and flows across the substrate in the plating cell.

Present day electroplating cells employ a simple technique to inject fluid into the process vessel or cell. Usually, a simple pipe or tube is used with an open end that supplies the solution into the tank or cell. The solution is forced from the open end of the pipe. This technique is not conducive to producing a flat coating, due to the fact that the liquid is not uniformly distributed across the surface of the workpiece. This technique can create high points and low points in the resulting plated layer, because of localized eddies and turbulences in the flow regime.

In the plating cell as described in said U.S. Pat. 5,597,460, a plating bath contains the electrolyte or plating solution, in which the substrate to be plated is submerged in the solution. A sparger or equivalent injection means introduces the solution into the plating bath and forms a laminar flow of the electrolyte or plating solution across the surface of the substrate to be plated. Adjacent the plating bath is an anode chamber in which anode material is disposed, with the material being contained within an anode basket. In a typical CD-stamper forming process, the anode material is in the form of pellets, chunks or nuggets of nickel, which are consumed during the plating process. A weir separates the plating bath from the anode chamber, and permits the plating solution to spill over its top edge from the plating bath into the anode chamber. The weir is in the form of a semipermeable barrier that permits nickel ions to pass through from the anode chamber into the plating bath, but blocks passage of any particulate matter. A circulation system is coupled to the drain outlet to draw off the solution from the anode chamber, together with any entrained particles, and to feed the solution through a microfilter so that all the particles of microscopic size or greater are removed from the plating solution. Then the filtered solution is returned to the sparger and is re-introduced into the plating cell. In this way a backwash of the plating solution is effected, so that the flow regime of the fluid itself washes any particulates out of the anode chamber in the direction away from the plated article. At the same time, the cleansed and purified solution bathes the plated surface of the substrate as a uniform, laminar flow of solution, thus avoiding high spots or voids during plating. As a result, very high tolerance is achieved, permitting production of compact disks of extreme density without significant error rates.

The flow regime as described in said U.S. Pat. No. 5,597,460 is further improved by the geometry of the well that forms the tank for the plating bath. In that patent the substrate can be positioned on either a fixed or a conventional rotary mount. A conventional cathodic motor rotates the substrate, e.g. at 45–50 RPM. The substrate can be preferably oriented anywhere from vertical to about 45 degrees from vertical. The well has a cylindrical wall that is coaxial with the axis of the substrate. This arrangements avoid corners and dead spaces in the plating cell, where either the rotation of the substrate or the flowing movement of the plating solution might otherwise create turbulences.

A U-tube laminar flow sparger, shaped to fit on the lower wall of the plating bath or plating cell, can be positioned adjacent the base of the weir to flow the solution into the space defined between the substrate and the weir. The sparger's flow holes are directed in parallel to create a uniform, laminar flow of the electrolyte across the planar face of the substrate. The axes of the flow holes in the sparger define the flow direction of the plating solution, i.e., generally upwards and parallel to the face of the plated substrate.

Unfortunately, even with these improvements, the plating is not completely even over the substrate. There is a tendency for hydrogen bubbles to accumulate on the surface of the substrate where electrolytic plating is taking place, and these can interfere with the plating and cause errors in the data on the CD master. Also, with conventional plating there is a tendency for the plated surface to become bowed out, that is, for the plated metal layer to lose its flatness away from the center. Consequently, it is necessary to plate a large margin around the target CD master or stamper, so that center part will have the desired flatness. This necessitates using additional time and materials.

Megasonics have been employed in semiconductor wafer processing, but only in connection with cleaning of the wafers prior to plating or etching. Several megasonic devices have been proposed for this purpose, and some of these have been made the subject of U.S. patents.

Shwartzman et al. U.S. Pat. No. 4,118,649 relates to a transducer assembly for producing acoustic energy at megasonic frequencies, i.e., from about 0.2 MHz to about 5 MHz, and applying the megasonic energy to a cleaning tank. Guldi et al. U.S. Pat. No. 5,520,205 and Bran U.S. Pat. No. 5,365,960 each relate to a megasonic cleaning assembly for cleaning semiconductor wafers in a cleaning tank. The megasonic energy is used to loosen material from the surface of the wafers, and it apparently did not occur to anyone involved with the above-mentioned patents to apply megasonic energy for the opposite purpose, namely, to assist in depositing material on the surface of the wafers.

In a metal plating technique, flow regime for the plating solution within the tank or cell is crucial for successful operation. Flow regime is affected by such factors as tank design, fluid movement within the plating cell, distribution of fluid within the cell and at the zone of introduction of the solution into the vessel, and the uniformity of flow of the fluid as it is contacts and flows across the workpiece. However, optimal sparger design can only achieve a limited increase in flatness of metallization.

OBJECTS AND SUMMARY OF THE INVENTION

Accordingly, it is an object of this invention to provide a plating cell which is simple and compact in design, which lays down an even plating without necessity to rotate the substrate, and which avoids the drawbacks of the prior art.

It is another object of this invention to provide a plating cell with a mechanism for removing from the substrate any hydrogen bubbles or other byproducts that may form during the plating process.

It is a further object to provide a plating cell with a rotary blade or wiper which avoids the necessity for any external motor or other mechanical drive means, and whose operation does not generate additional particulates or other foreign contaminants.

It is a significant object of the this invention to improve the flow regime of a galvanic or an electroless plating cell, and in particular to permit the plating process to achieve coatings of high uniformity across the surface of a substrate.

It is a further object to improve a plating process by applying megasonic energy to the solution in the cell during a plating operation.

According to an aspect of the present invention, in a plating cell, a planar face of a substrate is plated with a metal layer. A plating bath contains an electrolyte, in the case of a galvanic process, or an electroless plating solution if an electroless process is used. The substrate is immersed in the solution in the cell. A sparger introduces the electrolyte or electroless solution into the plating bath.

In the electrolytic arrangement, an anode chamber contains an anode basket holding a quantity of metal that is consumed during plating. A weir separates the anode chamber from the bath and permits the electrolyte to spill over from the bath into the anode chamber. The weir can have a semipermeable membrane wall that permits metal ions to pass through from the anode chamber into said plating bath, but blocks the flow of the electrolyte and any entrained particulates. A drain outlet carries electrolyte and any entrained particulate matter from the anode chamber. Also, conditioning and handling equipment coupled between the drain outlet and the sparger removes any particulate matter from the electrolyte and returns the electrolyte through a return conduit to the sparger. A rotary blade or wiper is positioned in the plating bath between the semipermeable membrane wall and the substrate, and has an edge disposed a predetermined distance from the planar face of the substrate. This distance is below about one-half inch, and is preferably about three-eighths inch. Preferably, the blade or wiper is pitched in the direction, relative to the rotational direction of the wiper, such that the rotating wiper tends to pull the electrolyte, plus any hydrogen bubbles, away from the substrate. The rotary wiper is most preferably fluid powered, and is coupled to the electrolyte return conduit to receive a flow of the electrolyte as motive power therefor. In several preferred embodiments, the fluid powered wiper includes an annular turbine having a generally circular opening therethrough, with the annular turbine being mounted in a circular mount therefor that is disposed in the plating bath. The circular opening is in registry with the substrate face that is to be plated. The blade is mounted on the annular turbine to extend radially towards a center of said circular opening. The annular turbine can have vanes disposed around its periphery, and the circular mount can have an annular recess that covers the periphery of the turbine and around which the vanes travel. A conduit is provided from the return conduit to the annular recess to propel the turbine and vane. As the same filtered and conditioned electrolyte that is fed through the sparger into the plating bath is also used to power the turbine, the leakage from this turbine will not in any way contaminate or dilute the electrolyte in the plating bath. The same materials that are used in the walls of the plating cell, e.g., a high quality polypropylene or PFA Teflon, are also used for the rotary blade, turbine, and mount. The annular turbine can be supported for rotation by rollers (formed of the same or a compatible plastic resin) mounted on the support for the annular turbine. This avoids the need for any bearings or metallic parts. In other possible embodiments, a different motor mechanism could be employed to rotate the blade or wiper.

The speed of rotation of the blade can be controlled for optimal plating, and can be between 35 and 80 rpm, preferably about 50 to 60 rpm.

In addition, a megasonic transducer adjacent the floor of the plating cell applies megasonic energy at a frequency of about 0.2 to 5 MHz to the solution. The frequency can be above 1 MHz, and in some cases above 5 MHz. The megasonic energy can be applied continuously or intermittently. The combination of the rotary blade and megasonic agitation avoids regions of dead flow and ensures uniformity of the metallization thickness and quality.

The plating arrangement can also include a rapid drain feature for removing the solution within a few seconds from the plating cell at the end of a plating operation. This can comprise a large drain tube, e.g., one-and-one-half inch diameter, opening to the bottom of the plating cell. In the case of electroless plating, an overhead rinse arrangement is also provided, comprising a pair of parallel tubes with sprinkler nozzles or heads disposed along their length. These features combine to terminate the plating operation rapidly when the plating operation has reached completion.

The plating arrangement for wet plating a substrate can comprise a plating cell that contains a solution in which the substrate is immersed; sparger means in the plating cell adapted to introduce the solution into the cell; spillover means on the cell that permits the solution to spill over from the cell into a fluid return that is adapted to carry away the solution from the cell; carrier means for holding the substrate in the cell below the spillover means; fluid conditioning means coupled between the return and the sparger means to remove any particulate matter from the solution, condition the solution, and return the solution through a conduit to said sparger means; rotary blade disposed in the bath and facing to rotate about an axis normal to the workpiece; and megasonic transducer means in communication with the plating cell for applying to the solution in the cell acoustic energy at a megasonic frequency, either intermittently or continuously. Preferably the spillover means on the plating cell includes a succession of triangular teeth disposed along an upper edge of the plating cell. This serrated spillover may be at the weir that separates the anode and cathode chambers.

The above and many other objects, features, and advantages of this invention will become more fully appreciated from the ensuing detailed description of a preferred embodiment, which is to be considered in conjunction with the accompanying Drawing.

DETAILED DESCRIPTION OF THE PREFERRED EMBODIMENT

Figure 1:
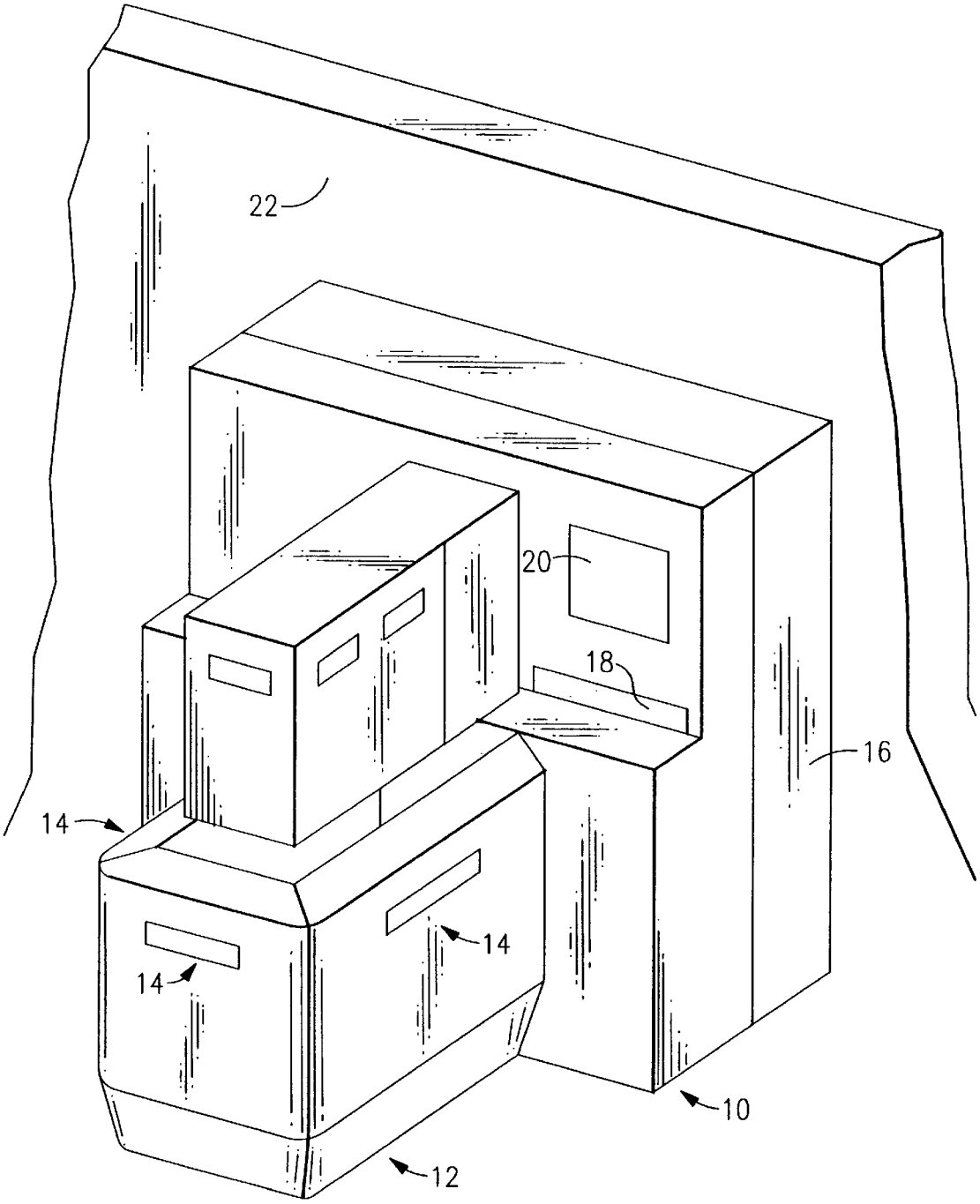
FIG. 1 is a perspective view of an electroplating assembly incorporating the plating cell of this invention.

With reference to the Drawing, and initially to FIG. 1, a plating assembly 10 is here shown as may be used in the manufacture of masters and stampers for compact discs, and which incorporates the plating cell according to an embodiment of this invention. The assembly 10 has a front peninsula 12 that comprises three plating stations 14, one each at the front, the right side, and the left side of the peninsula 12. A rear cabinet 16 contains the main solution tank or reservoir, as well as the associated filtration, pumps, heating equipment and the like. A pull-out control panel 18 is here shown retracted in the right-hand side of the rear cabinet 16, and above this is a video screen 20 to provide status and process information. Microprocessor controls are provided within the cabinet 16. The plating cells, conduits, reservoirs, and the cabinets can all be made of an inert, non-reactive material, and favorably a plastic resin, e.g., polypropylene or another material such as PFA Teflon. The assembly can be easily situated within a clean room in a manufacturing plant, and in this view the assembly is positioned against one wall 22 of a clean room.

The process flow circuit can be generally configured as shown in my U.S. Pat. No. 5,597,460, which is incorporated herein by reference. As in that arrangement, the electrolyte is injected by a sparger into the cathode chamber, backwashed into the anode chamber, and exits the anode chamber to filters, pumps, and a reservoir, where the electrolyte temperature is adjusted as necessary. Then the electrolyte is fed back to the sparger.

Figure 3:
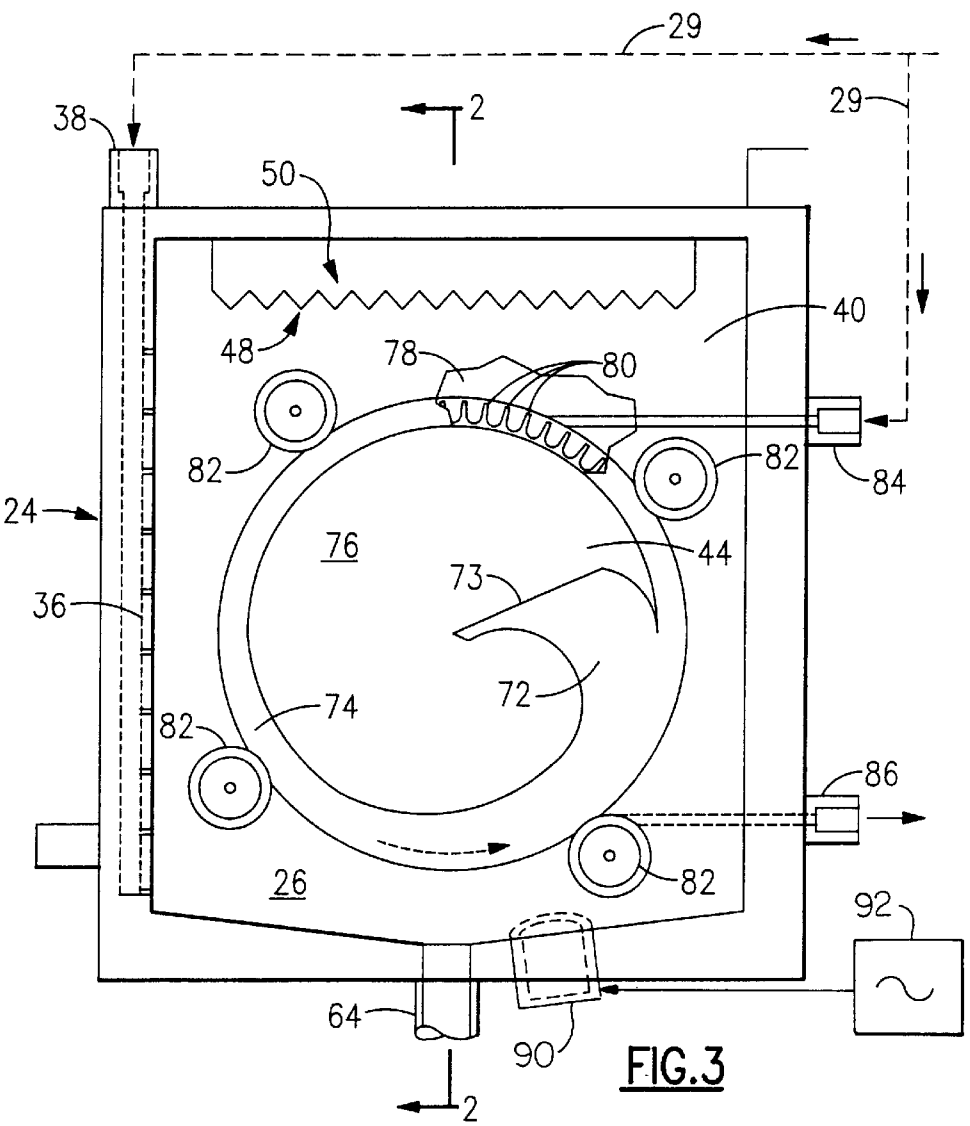
FIG. 3 is a front sectional elevation of this embodiment, taken at 3—3 of FIG. 2.
Figure 2:
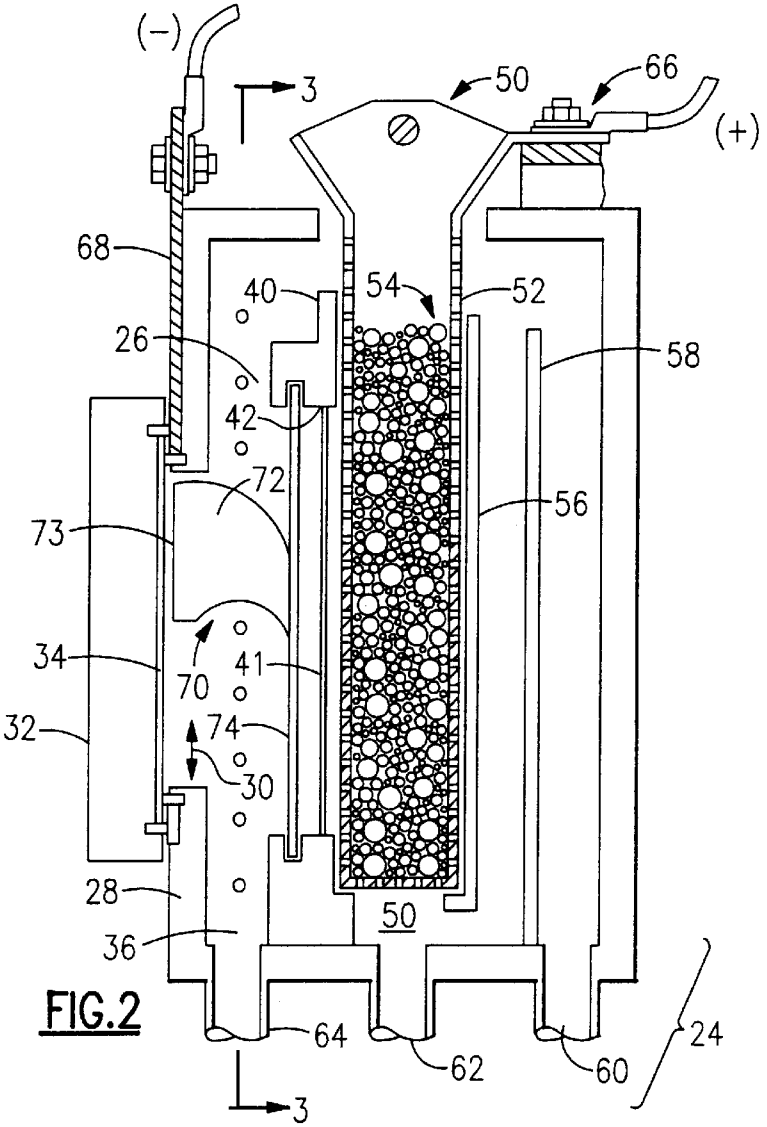
FIG. 2 is a cross sectional elevation of a plating cell according to one preferred embodiment of this invention.

An improved plating cell 24 according to an embodiment of this invention is illustrated in FIGS. 2 and 3. Here plating cell 24 is of generally rectangular shape, with a cathode chamber 26 adjacent a vertical front wall 28. The front wall 28 has a circular opening 30 onto which is fitted a cover and plate holder 32. A substrate 34, in the form of a glass plate etched with digital tracks and covered with a conductive coating, e.g., by sputtering, is fitted into the plate holder 32 and serves as the cathode. In this embodiment, the cover or plate holder is bolted onto the front wall 28, but in other embodiments, a suitable plate holder could be slid vertically into the plating cell and removed likewise by sliding vertically. Such an arrangement could facilitate automating the loading and unloading operation, and makes the plating cell amenable to robotization.

A sparger 36, here a vertical member, has a series of flow holes for producing a lateral non-turbulent flow of electrolyte, and is disposed at one side of the cathode chamber 26. A sparger inlet 38 receives the flow of electrolyte from the reservoir via a return conduit 29. The latter is schematically represented by dash line. On the side of the cathode chamber 26 away from the holder 32 is a weir 40, in the form of a generally vertical wall having a circular opening 42 that is situated generally in registry with the substrate 34. There is a semi-permeable membrane 44 across the opening to permit metal ions dissolved in the electrolyte to pass, but which blocks the flow of the liquid electrolyte. At the top edge of the weir 40 is a spillway 48, here of a sawtooth design, which facilitates flow of the electrolyte over the weir 40 into an anode chamber 50. The triangular teeth or serrations on the spillway 48 reduce the surface tension drag, both improving the cascading and also minimizing leveling procedures during installation. The anode chamber 50 contains an anode basket 52 containing a fill of nickel pellets 54 which are consumed during the plating process. The process fluid washes over the pellets in the anode basket, and then proceeds around an anode basket locating plate 56 (behind the basket 52). The electrolyte then flows over an anode chamber leveling weir 58, and proceeds out a main process drain 60. The electrolyte thence continues to the equipment within the cabinet 16, where it is filtered and treated before being returned through the return conduit 29 to the sparger 36. Also shown at the base of the anode chamber and cathode chamber, respectively, are an anode chamber clean-out drain 62 and a cathode chamber dump drain 64. These drains 62 and 64 are normally kept closed during a plating process, but are opened after the plating process is complete to empty the cathode and anode chambers. The drain 64 can include pipe of relatively large diameter, here about one and one-half inches, so that all of the liquid in the tank can be drained away in a few seconds at the end of a plating cycle.

Shown in FIG. 2 is an anode conductor 66 coupled to the anode basket 52 and to a positive terminal of the associated rectifier. Also shown is a cathode conductor 66 that connects the substrate 34 via a cathode lead to a negative terminal of the rectifier.

Figure 4:
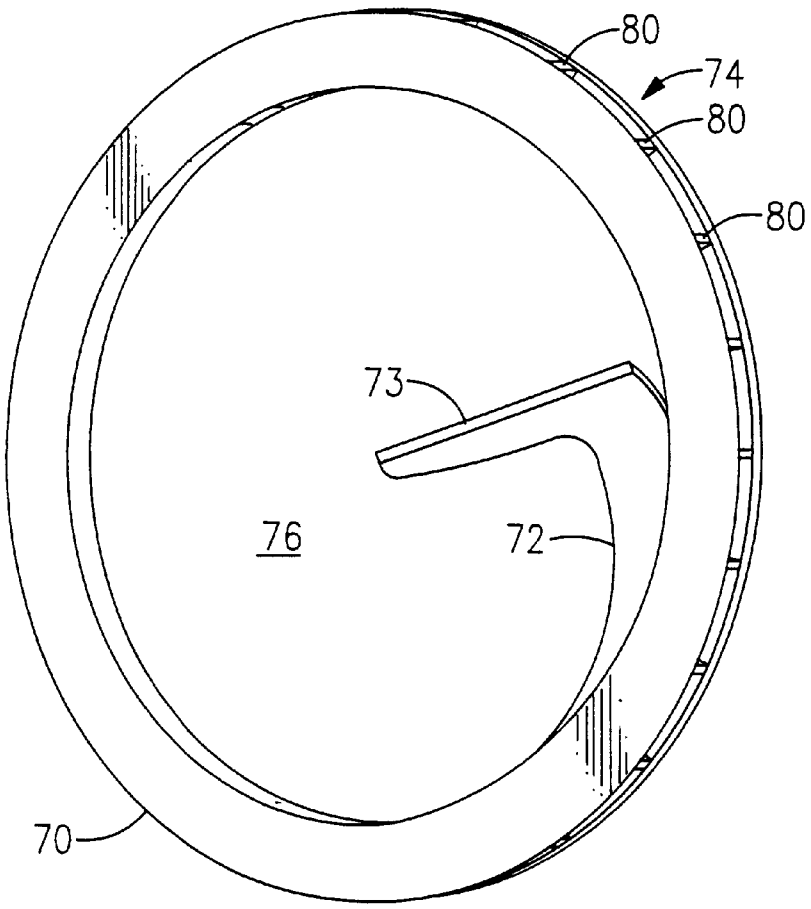
FIG. 4 is a perspective view of the rotary wiper and turbine element of this embodiment.

As shown in FIG. 3 a rotary wiper or blade unit 70 is fitted into the weir 40, which serves as a mount for the wiper unit 70. The wiper unit, shown also in FIG. 4, is unitarily formed of a suitable inert material, and preferably polypropylene. A curved blade 72 extends generally proximally towards the substrate and has a generally linear radial edge 73 that is positioned a short distance from the substrate 34. This distance should be less than one inch, preferably below a half inch, and in this embodiment this distance is about three-eighths inch. The blade is unitarily formed onto an annular turbine member or ring member 74. This member 74 has a central opening 76 which permits the electrolyte to pass through between the substrate 34 and the membrane 44, and the blade extends inwardly from the ring member to a center of the opening 76, and also is curved from the plane of the turbine member towards the substrate 34 in the holder. The turbine member 74 fits into an annular chamber 78 in the weir 40, that can surround the opening 42. The periphery of the annular turbine 74 is provided with radially extending vanes 80 that travel in the chamber 78. Four roller members 82 are disposed radially outside the opening 42 of the weir 40, and provide rotational support for the turbine 74. An inlet conduit 84, which is coupled to the return conduit 29, and which also feeds the sparger 36, brings a flow of the electrolyte into the annular chamber 78 to propel the turbine 74, and an outlet conduit 86 conducts the electrolyte from the chamber 78 to a drain. The turbine 74 rotates in the direction of the arrow, and the blade is curved in the sense so that it draws fluid away from the substrate 34, that is, in the distal direction, towards the anode.

In this embodiment, the rotary blade is shown positioned on the weir 40, but in other possible embodiments, the blade and turbine could be positioned elsewhere in the plating cell 24. For example, the rotary blade could be made a part of the cover or holder 32.

Figure 5:
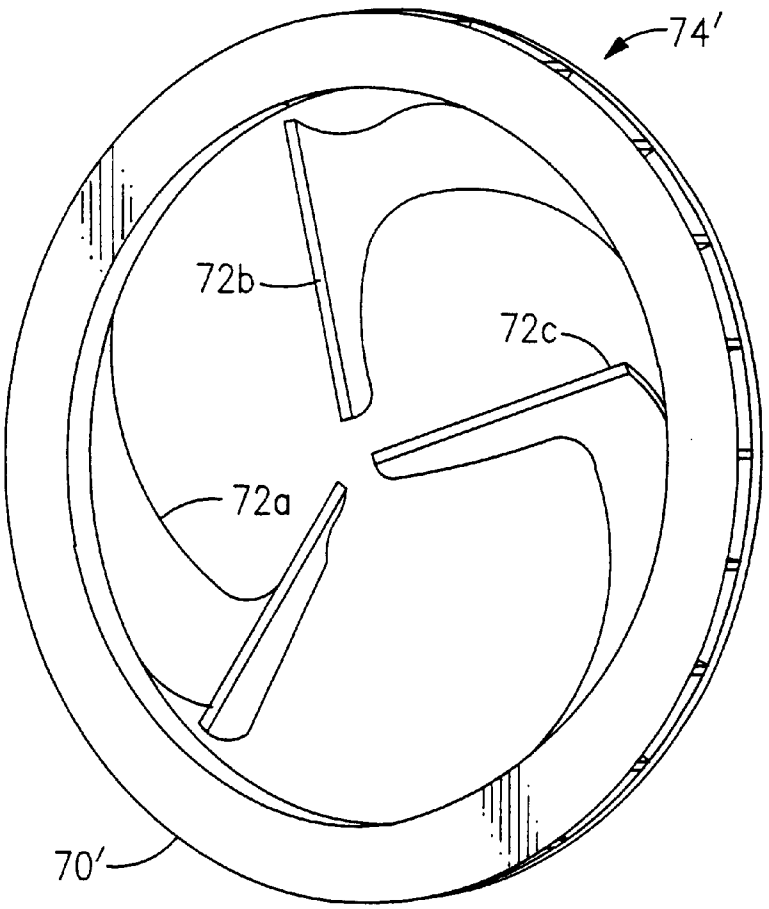
FIG. 5 is a perspective view of an alternative wiper element.

An alternative arrangement of the wiper unit of this invention is shown in FIG. 5. Here the wiper unit 70' has three blade members 72*a*, 72*b*, 72*c*, disposed at angular separations of about 120 degrees on the annular turbine 74'. This arrangement could permit a lower rotational speed, which may be called for in some plating operations.

Figure 6:
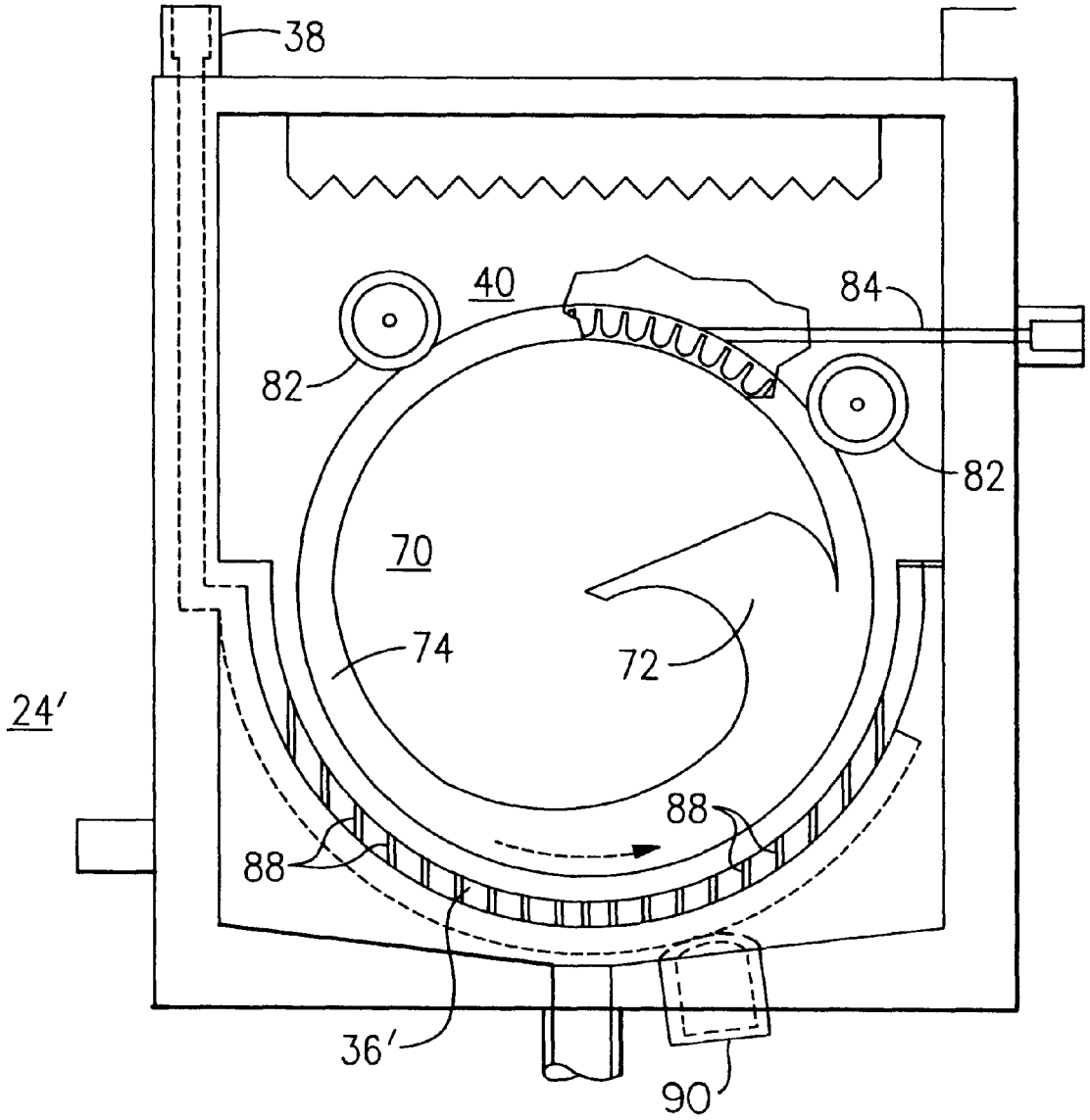
FIG. 6 is a front sectional elevation of an alternative embodiment, with U-tube sparger.

Another plating cell arrangement is shown in FIG. 6, in which elements that are also shown in FIG. 3 are identified by the same reference numbers. Here rather than a vertical sparger this plating cell 24' has a U-tube sparger 36', which is arranged to provide a laminar vertical flow of electrolyte. Here the sparger 36' is provided with parallel, vertically oriented flow holes 88. The remaining elements of this embodiment are substantially the same as described earlier.

A generally rectangular, elongated transducer 90 is situated in the base or bottom of the cathode chamber 26 at about the center and extending from a front end to a rear end. The transducer may also extend under the anode chamber. This transducer 90, as described, e.g., in my copending application Ser. No. 08/873,154, is adapted for generating megasonic acoustic energy which is applied to the solution within the plating cell 24. A variable frequency generator 92 applies an A.C. signal to the transducer 90 at a frequency in the megasonic range, that is, between about 200 KHz and about 5 MHz. The generator 90 can apply a steady signal at a single frequency, a signal that alternates between two frequencies, or a signal that sweeps across a broad band of frequencies, depending on the plating process. There is also a nitrogen purge supply for applying nitrogen gas to the transducer.

In operation, the flow through the inlet conduit 84 to the annular turbine channel 78 is controlled so that the wiper unit 70 turns at a desired rotational speed. This is adjusted to the particular process and environment so as to remove hydrogen bubbles from the substrate, but without cavitating or causing any disruption in the evenness of the plating. I have found that a suitable rotational speed for the wiper is between about 35 rpm and 80 rpm, and preferably about 50 to 60 rpm. Leakage of the electrolyte from the annular chamber 78 into the cathode chamber 26 will have no adverse affect on the plating process. This is the same purified liquid that is being fed to the sparger 36, and does not dilute it nor contain any contaminant particles.

In the above-described embodiment, the plating cell 24 is set up for a non-rotating, vertically disposed substrate 34. However, the self-propelled wiper arrangement could easily be configured for a rotating substrate. Also, the plating cell of this invention could have the holder 32 and substrate 34 tilted at some angle, rather than vertical. Favorable results have been obtained with the holder and substrate tilted at a back angle, that is, with the axis of the substrate 34 facing slightly upwards. Further, in some possible embodiments, the plating cell could employ electrical or mechanical drive means for the rotary wiper, as best suits the particular plating process, rather than the fluid-driven wiper described hereinabove.

With the plating cell 24 as described, I have been able to achieve superior flatness in the plating across the entire plated surface of the substrate. This results in higher speed plating, with greater repeatability and lower scrap rate than with the prior art systems, and is particularly superior to the results obtained with conventional cathodic motor plating systems.

The plating solution is supplied to the sparger(s) 36 and is introduced into the cathode chamber 26, which fills to the level of the saw-tooth spillway of the weir 40. The solution is supplied continuously, so that there is a continuous upward flow of the solution through and past the workpiece. The process continues for a prescribed length of time. During this time, the megasonic frequency generator 92 supplies a megasonic signal to the transducer 90, which creates megasonic waves in the plating solution. The blade or wiper 70 sweeps over the workpiece at a suitable speed, e.g. 50 to 60 r.p.m. These effects combine to create a plated layer of uniform thickness and quality.

At the end of the plating period, the megasonic transducer is turned off, and the supply line is turned off to stop the supply of fresh solution to the sparger(s) 36. The contents of the plating cell are drained out through the drain 64 in a few seconds. Then a de-ionized water supply is turned on, and is sprayed onto the workpiece to rinse same. The rinse water then proceeds out the drain 64.

It should be appreciated that the reservoir and associated process management equipment can be employed in common with a number of plating cells. In addition, the plating cell can be connected to a number of plating reservoirs, each containing a different plating solution and associated with different process steps.

While the invention has been described with reference to a preferred embodiment, it should be recognized that the invention is not limited to that precise embodiment, or to the variations herein described. Rather, many modifications and variations would present themselves to persons skilled in the art without departing from the scope and spirit of the invention, as defined in the appended claims.

What is claimed is:

1. An electroplating cell for plating a planar face of a substrate with a metal layer, comprising a plating bath containing an electrolyte in which said substrate is immersed in a cathode chamber of the bath, sparger means adapted to introduce the electrolyte into the cathode chamber, an anode chamber in which an anode is disposed and which contains a quantity of metal that is consumed during plating, a weir which separates said anode chamber from said cathode chamber and permits the electrolyte to spill over from the cathode chamber into the anode chamber, said weir including means for permitting metal ions to pass through from the anode chamber into said cathode chamber, drain outlet means adapted to carry electrolyte and any entrained particulate matter from the anode chamber; means for holding the substrate in the cathode chamber; means coupled between the drain outlet and the sparger means to remove any particulate matter from said electrolyte and return the electrolyte through a return conduit to said sparger means; a fluid powered rotary blade disposed in said bath and having an edge disposed generally in a plane spaced from the planar face of the substrate, and having fluid powered motor means formed therewith for rotating the blade, including means coupled to said return conduit to receive a flow of said electrolyte as motive power therefor; and megasonic transducer means in communication with said plating cell for applying to the solution in said cell acoustic energy at a megasonic frequency.

2. An electroplating cell according to claim 1 wherein said motor means includes an annular turbine having a generally circular opening therethrough, said annular turbine being mounted in a circular mount therefor in said bath, such that the opening is in registry with the planar face to be plated, and wherein said blade is mounted on said annular turbine to extend radially towards a center of said circular opening.

3. An electroplating cell according to claim 1 wherein the blade has a pitch and a rotational direction such that when the blade is rotated the blade pulls the electrolyte away from said substrate.

4. An electroplating cell according to claim 1 wherein said blade is spaced from said substrate a distance of about one-half inch or less.

5. A process of plating a planar face of a substrate with a metal layer in an electroplating cell wherein a cathode chamber of a plating bath contains an electrolyte in which the planar face of said substrate is immersed, said substrate being held in a plating position in said cathode chamber, an anode in an anode chamber contains a quantity of metal that is consumed during plating, a weir separates said anode chamber from said cathode chamber and permits the electrolyte to spill over from the bath into the anode chamber, said weir including means permitting metal ions to pass through from the anode chamber into said cathode chamber, drain outlet means carry electrolyte and any entrained particulate matter from the anode chamber; means coupled between the drain outlet and the sparger means remove any particulate matter from said electrolyte and return the electrolyte through a return conduit to said sparger means; and a fluid powered rotary blade disposed in said bath rotates at a spacing from the planar face of the substrate; the process comprising: circulating said electrolyte through said return conduit and said sparger into said bath to create a transverse flow of said electrolyte across said planar face; applying a plating current between said anode and said planar face to effect cathodic deposition of said metal onto said planar face; supplying a portion of the electrolyte from said return conduit into motive means for rotating said blade; and wherein said motive means includes an annular turbine having a generally circular opening therethrough, said annular turbine being mounted in a circular mount therefor in said bath, such that the circular opening is in registry with the planar face to be plated, and wherein said blade is mounted on said annular turbine to extend radially towards a center of said circular opening; said step of supplying a portion of said electrolyte into said motive means includes injecting said electrolyte into said circular mount so as to urge vanes on said annular turbine into rotation; and applying megasonic acoustic energy to the electrolyte in said cathode chamber.

* * * * *